US005438972A

United States Patent [19]

Harbin

[11] Patent Number: 5,438,972

[45] Date of Patent: Aug. 8, 1995

[54] MAGNETIC TARGET TOY

[76] Inventor: John J. Harbin, 376 Brookdale Avenue, Toronto, Ontario, Canada, M5M 1R2

[21] Appl. No.: 226,888

[22] Filed: Apr. 13, 1994

Related U.S. Application Data

[63] Continuation-in-part of Ser. No. 66,443, May 25, 1993, abandoned.

[30] Foreign Application Priority Data

May 21, 1993 [GB] United Kingdom ..... 2269543

[51] Int. Cl.[6] ..... F41B 7/08; F41J 3/00; A63B 67/00

[52] U.S. Cl. ..... 124/27; 124/16; 124/44.6; 124/21; 273/345; 273/346; 273/424; 273/DIG. 5

[58] Field of Search ..... 124/1, 16, 21, 26, 23.1, 124/44.6, 27; 273/317, 345, 346, 347, 348, 424, 425, 405, DIG. 5, DIG. 30

[56] References Cited

U.S. PATENT DOCUMENTS

| | | | |
|---|---|---|---|
| 2,112,946 | 4/1938 | Yates | 124/26 |
| 2,563,969 | 8/1951 | Skinner | 124/26 |
| 2,586,039 | 2/1952 | Heggedal | 273/DIG. 5 |
| 2,645,490 | 7/1953 | Volman | 273/345 X |
| 2,784,711 | 3/1957 | Vaughn | 124/27 X |
| 3,026,110 | 3/1962 | Hess et al. | 273/345 |
| 3,161,410 | 12/1964 | Cunningham | 273/347 X |
| 3,232,285 | 2/1966 | Rasner | 124/27 X |
| 4,119,316 | 10/1978 | Kettlestrings | 273/345 |
| 4,166,618 | 9/1979 | Sheem | 273/346 X |
| 4,305,587 | 12/1981 | O'Grady | 273/345 |

FOREIGN PATENT DOCUMENTS

| | | | |
|---|---|---|---|
| 1316251 | 12/1962 | France | 273/345 |
| 2400135 | 7/1974 | Germany | 273/345 |
| 622771 | 5/1949 | United Kingdom | 124/26 |
| 985644 | 3/1965 | United Kingdom | 273/345 |
| 993254 | 5/1965 | United Kingdom | 273/346 |

OTHER PUBLICATIONS

"Vinyl Put-On's", Basic Bodywork And Painting by Petersen's Publishing 1975, p. 186.

*Primary Examiner*—Anthony Knight

[57] ABSTRACT

A washer shaped magnetic missile is combined with a launcher having a probe which supports the missile by extending through its aperture. The washer and launcher magnetically couple but relatively weakly so that deceleration of a travelling launcher will release the missile, off the probe toward a target. The forward face of the missile may be adapted for magnetic, or other couple to a target. There is also shown a flimsy target which may cling to a ferromagnetic surface for use with the missile.

7 Claims, 2 Drawing Sheets

MAGNETIC TARGET TOY

Figure 1:
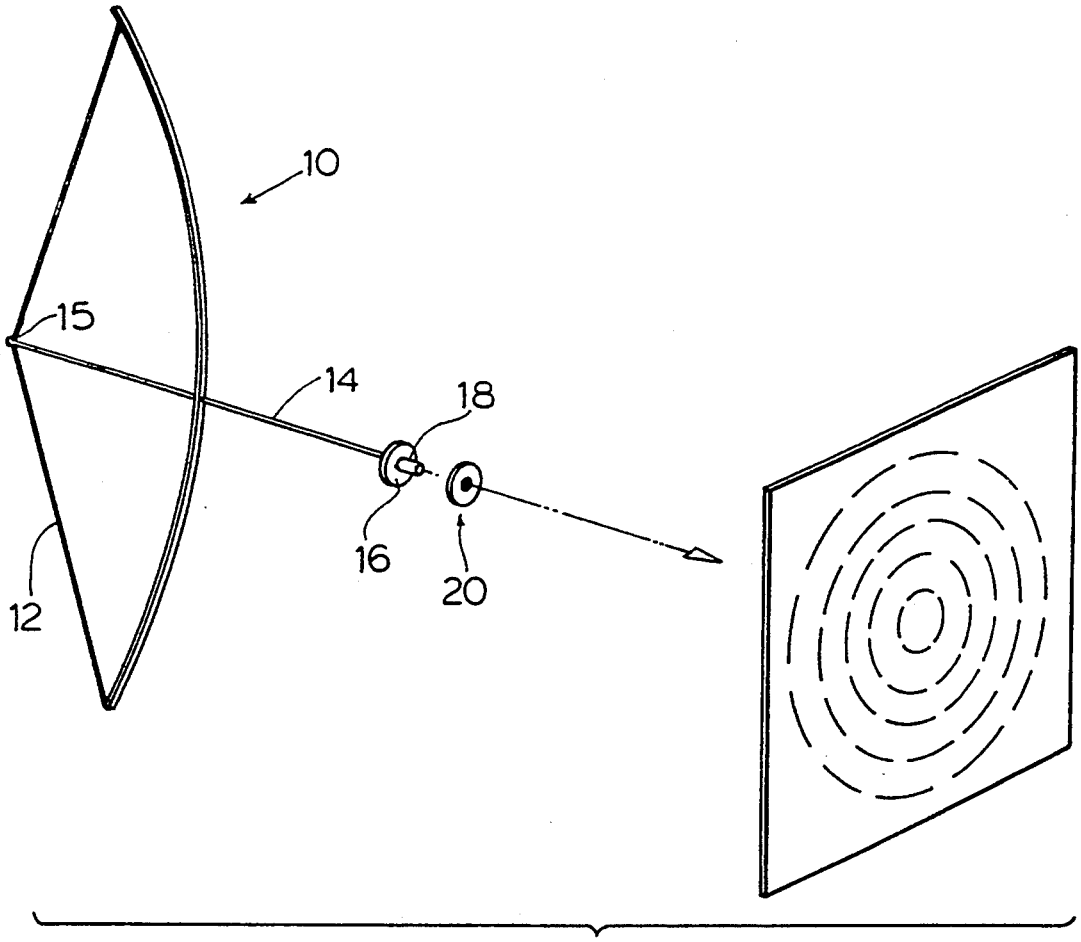

This is a continuation-in-part of application Ser. No. 08/066,443 filed May 25, 1993 now abandoned.

This invention relates to a toy magnetic missile and launcher, to a target therefor, and to the combination.

With respect to the missile and launcher it is noted that there are many prior patents wherein a magnetic missile, usually in the shape of a flat disk or washer is magnetically coupled to a launcher surface. The launcher with the missile magnetically attached, is caused to move forwardly at a predetermined velocity, and then decelerated suddenly, the force of deceleration being sufficient to overcome the magnetic coupling between missile and surface and to launch the missile towards a target.

There are many examples of the arrangement described in the previous paragraph. These examples will demonstrate that the form of the launcher may vary widely (at least so far as the advantages of this invention are concerned). For example such a launcher and missile is shown in the form of: a cross-bow (see my U.S. Pat. No. 5,247,920 dated Sep. 28, 1993); a revolver (see the patent to Zimmerman U.S. Pat. No. 2,627,260,) or an ordinary bow, or spring launcher as shown in the specific embodiments herein and may also be a compressed air device.

In all such applications the missile has a flat surface and magnetically couples to a ferromagnetic flat surface of a launcher. The magnetic coupling should maintain the missile in place until released but must be weak enough to allow such release. Since such magnetic coupling must be weak there is a risk that the missile will be inadvertently dislodged from the launcher during handling or aiming or, at any event, before the planned release.

In accord with one of the principal objects of the invention, I provide the launcher surface with a forwardly extending probe and the missile with an aperture dimensioned to allow the missile to be slidably received on the probe for magnetic coupling to the launching surface. The probe is shaped and directed to allow release of the missile in a forward direction when the forwardly moving launcher is decelerated. It will be noted that the probe supports the magnetically coupled missile against inadvertent dislodgement in all situations where the dislodging force has a component perpendicular to the forward direction. Thus the probe is advantageous in the following situations:

a) It permits more vigorous movement, in handling and aiming the launcher and missile;

b) It permits design of the launcher and missile with less magnetic coupling. Reduction of the coupling increases the velocity of the launched missile whose momentum varies inversely as the amount of force required to effect release from the magnetic coupling;

c) It allows the use of heavier shooting disks for a given magnetic coupling;

d) It allows the shooting disk, whether flexible or not, to be other than perfectly flat since the probe, in that event compensates for a reduced magnetic coupling. (A flexible disk attaches more easily to a target).

In accord with a preferred embodiment of the invention, the missile is provided with means for forwardly directing magnetic force (usually greater than the rearwardly directed coupling force) which allows the missile to attach to a ferromagnetic target. In a further preferred aspect, the disk is made of transversely running, forwardly facing north and south poles. Such disk will couple strongly to a target. Such disk supplies a relatively weak rearwardly directed magnetic force, found sufficient, given the support of the probe, for coupling to a ferromagnetic launching surface, In combination with the missile and launcher as defined above I provide a thin flexible, water impervious, sheet, bearing target indicia for attachment to a ferromagnetic surface. Such a water impervious sheet may be soaked in water and attached to the side of a car, truck, cookie tin or any other ferromagnetic surface, where it will cling for long enough for a game to be played. The missile will contact to the target, giving a measure of the shooter's skill, while being held on the target because it magnetically couples to the ferromagnetic natural therebehind.

Alternatively the thin flexible sheet with target indicia may be made of static-cling material, preferably vinyl which will cling, due to this quality, to a ferromagnetic surface while the game is played.

By 'ferromagnetic material' herein I include as well as iron, cobalt, nickel, their alloys and steel, I also include magnets having 'hard' or remanent magnetism.

Figure 2:
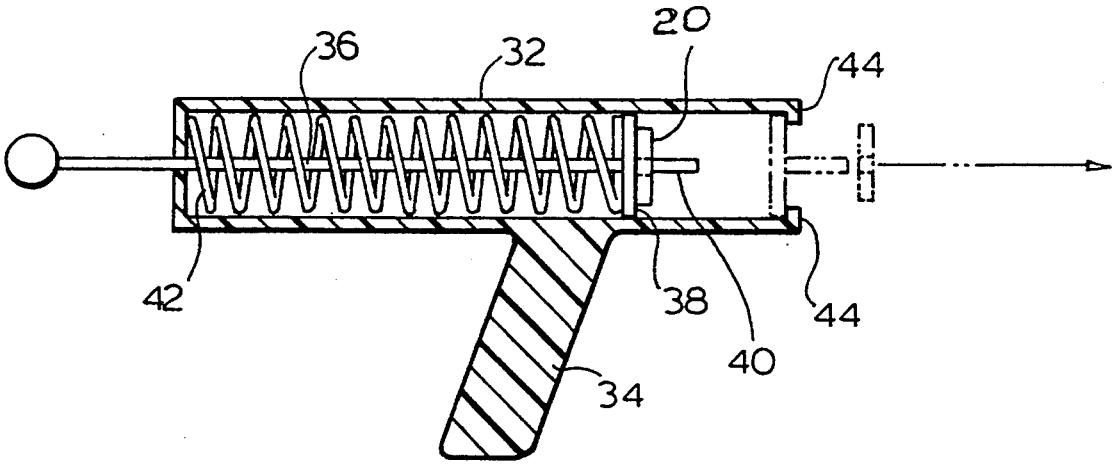
Figure 7:
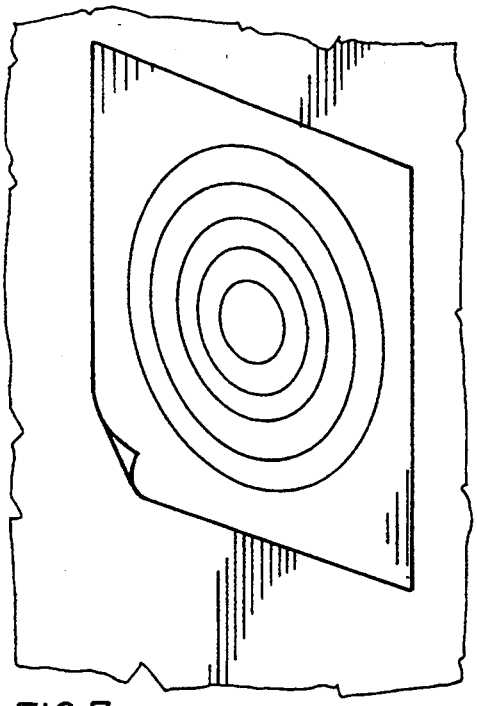
Figure 6:
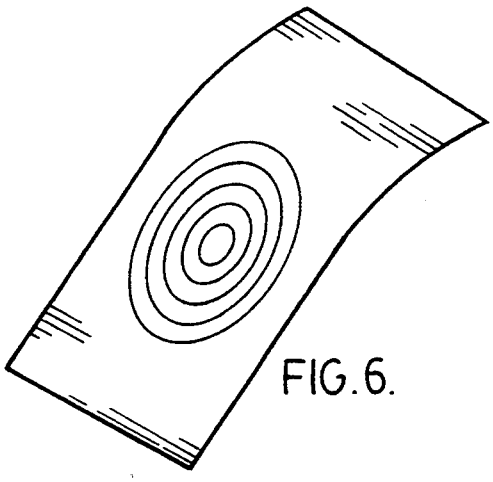
Figure 4:
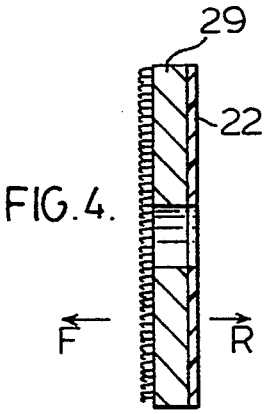
Figure 3:
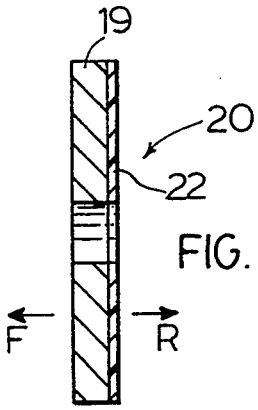
Figure 5:
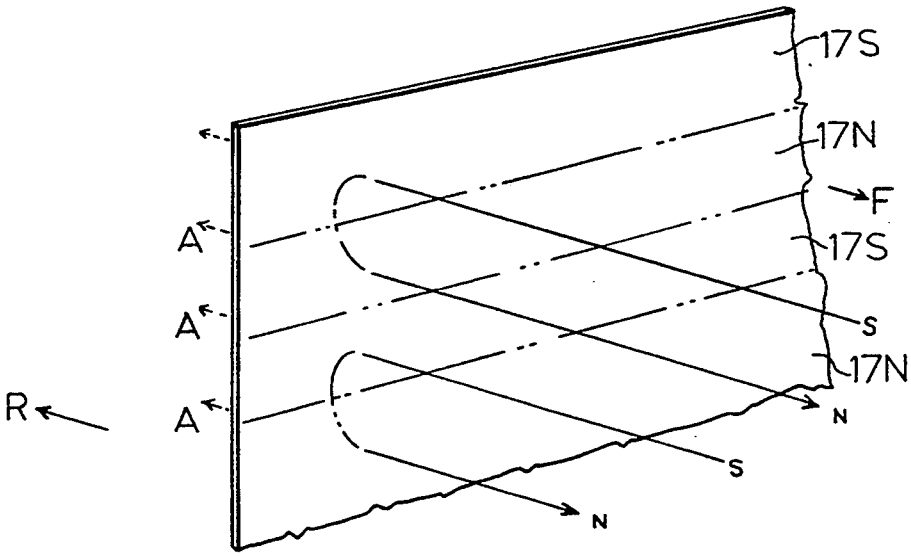

In drawings which illustrate a preferred embodiment of the invention:

FIG. 1 shows a bow and (captured) arrow where the forward end on the arrow has a launcher with a probe in accord with the invention, FIG. 2 shows a spring loaded launcher with a launcher and probe in accord with the invention, FIGS. 3 and 4 are sections taken in the forward-rearward direction of missiles in accord with the invention, FIG. 5 schematically represents a magnetic material suitable for the missile, and FIGS. 6 and 7 show the use of a thin flexible target.

In the drawings FIG. 1 shows a bow 10 with string 12 and captive arrow 14 whose rearward end 15 is apertured to receive the string. At the forward end of the arrow is a launcher having a forwardly facing, preferably circular, surface 16 of hard ferromagnetic material. Centrally located on the surface 16 is a forwardly directed probe 18. The probe may be hollow or solid. A missile 20 is principally made of magnetic materials, as hereinafter discussed, and is apertured to slidably receive the probe. The sides of the probe 18 extend smoothly in a forward-rearward direction, to allow easy release of the missile. The missile, as shown in FIG. 3 and 5 preferably uses of material 19 having as shown forwardly facing alternating strips defining north and south poles (facing forward direction F) which run in transverse strips 17N and 17S as best demonstrated in FIG. 5. As indicated in FIG. 5, arrows A indicated that there is a weak magnetic force from the missile material in the rearward direction R.

The magnetic material 19 is preferably flexible since this allows a missile to bend slightly on impacting a ferromagnetic target and to more frequently attach thereto.

The ferromagnetic launch surface 16 will preferably be required to be a 'hard' magnet but this will somewhat raise the magnetic coupling which correspondingly reduces the release velocity.

The disk with its forwardly facing poles preferably has a plastic rearward layer 22 which weakens the coupling and thus increases the release velocity. The coupling may be weakened, without inadvertent detachment of the missile, because of the extra Support for the missile provided by probe 18.

In operation, with the disk of FIGS. 3 and 5, the missile 20 is oriented with the strip magnets directed forwardly and placed on the probe and allowed to magnetically couple to the launcher surface 16. The bow 10 is flexed by drawing back the bowstring 12, and the arrow aimed at a ferromagnetic target. The target need not have remanent magnetism and thus may be ordinary iron or steel. After aiming, the bowstring is released. The deceleration of the forwardly moving arrow, when restrained by the string, overcomes the magnetic coupling between the missile and the launch surface, and the missile flies off the launcher and probe toward the target. During the: loading, handling, aiming, and release of the missile by the launcher, the probe supplies all the advantages a-d recited in the introduction.

FIG. 2 demonstrates that the launcher may, instead of a bow and arrow, may be of a gun shape having cylinder 32 and holder 34. Inside the cylinder bore a pull rod 36 mounts at its forward end a ferromagnetic launching surface 38 slidable on the walls of the cylinder. Forwardly projecting from the centre of the surface 38 is the probe 40. The rod

36 surface and probe are together urged forwardly by the compression spring 42. Flanges 44 at the forward end of the cylinder will abruptly halt the forward movement of the platform. Flanges 44 define an aperture. Missile 20 constructed as shown in FIG. 4 is mounted on the probe and at its rear layer 22 weakly couples to surface 38. The missile is dimensioned to pass freely through the cylinder flange 44 aperture. In operation, the missile is loaded on the probe 40 and coupled to the support surface 38. The cylinder is then aimed and the rod 36 withdrawn. The rod is released and when decelerated by flanges 44 releases the missile to fly toward the target.

As noted in the introduction, the launching surface and probe may be combined with any other means, e.g. compressed air, which allows the launcher and missile to achieve the desired velocity followed by the necessary deceleration to detach the missile and allow it to fly toward the target. In these other variants, probe supplies all the advantages a-d recited in the introduction.

FIG. 4 demonstrates that an apertured missile for mounting on a probe may be provided with means to rearwardly magnetically couple to a launching surface and a forwardly facing surface of hook or loop Velcro (TM) type material, which will attach to a Velcro (TM) coated target of the other hook or loop type. In this case it is not required that the missile provide forwardly directed magnetic force so that a simple magnet 29 may be used instead of the strip material.

FIGS. 6 and 7 demonstrate a thin (preferably plastic) sheet material with target indicia thereon. This may preferably be made of vinyl film. Thus the film with target indicia displayed, may be static-cling material for attachment to any ferromagnetic surface, such as the side of a car, panel truck etc., iron plate and so on.

The film of FIGS. 6 and 7 may be made of water impervious material may, and need not be static cling material. For use in this variant, it be soaked in water and temporarily attached to a ferromagnetic surface where the water will attach the target to the ferromagnetic surface long enough for a game to be played.

The advantages of the 'film' targets of FIGS. 6 and 7 are discussed in the introduction.

The target may be printed or painted with any target indicia desired such as bull's eye. Beside the standard rigid targets of ferrite material, I have found targets of reappliable, reuseable, flexible sheeting adapted to attach to a surface of magnetic material works very effectively in combination with the inventive missile and launching device offering additional benefits. For example a relatively thin target of non-magnetic flexible static cling vinyl may be applied to a ferromagnetic surface. This arrangement works effectively but will depend on how smooth and clean the magnetic surface is. The less the amount of coverage i.e. paint on the surface the better the results. The vinyl target is waterproof, can be crumpled and reused without damage, and when the static cling becomes less effective, the target backing can be moistened and reapplied for game play.

A target may be made of the strip material similar to that of FIG. 5 the exception both sides have multiple north and south poles permanently induced. The target is preferably attached to a ferromagnetic surface for use. The target surface and the missile must display sufficient magnetic attraction to cooperate and support the missile on the attached target.

The missile 20 or 29 may be of any size or shape which will magnetically attach to the arrow head and target and may be larger or smaller than the arrow head 16. Multiple missiles may be attached to the arrow head.

The remanent or hard magnetic material used for the missile and the magnetic surface of the arrow head is preferably strontium ferrite with a binder of synthetic rubber having multiple strips of alternating north and south poles magnetized on one side of the sheeting.

The hard magnetic material if used for a target is of like materials but with both sides of the target having multiple north and south poles permanently induced so that the target may be attached to any ferromagnetic surface. For these materials I prefer to use that sold under the Trade Mard ULTRA-MAG by Flex Mag Industrial Inc. of 4480 Lake Forest Drive, Suite 304, Cincinati, Ohio.

The non-magnetic target thin film material of FIGS. 5 and 6 is preferably a flexible static cling vinyl preferably about 0.6 millimeters thick. For this material I prefer to use that sold by Flex Con Canada Ltd, 5939 Wallace Street, Mississauga, Ontatio, Canada, L42 1Z8.

I claim:

1. Toy magnetic missile, and launcher comprising:

a mount comprising a forwardly facing surface having a probe forwardly projection therefrom, a missile being relatively flat and with forward and rearward missile surfaces; having an aperture, defined by edges, to receive said probe so that said probe supports said missile, said probe and said aperture edges being arranged to allow forward release of said missile from said probe, means for providing magnetic coupling between said forewardly facing surface and said missile, means for moving said mount and missile together, forwardly, with a predetermined velocity and decelerating it with a force to overcome said coupling and release said missile for motion forwardly from said probe.

2. Means as claimed in claim 1 wherein said missile is designed to provide a stronger magnetic force in the direction forward from the forward missile surface and a weaker magnetic force in the direction rearwardly from the rearward missile surface.

3. Means as claimed in claim 2 wherein said missile is provided with strips defining alternating north and south magnetic poles directed forwardly at the forward surface of said missile.

4. Means as claimed in claim 2 in combination with a thin flexible plastic sheet having static cling properties adapted to adhere to a ferromagnetic surface, said sheet having target indicia for said missile thereon.

5. Means as claimed in claim 4 wherein said plastic sheet is of vinyl.

6. Means as claimed in claim 2 in combination with a thin flexible sheet which is impervious to water, said sheet bearing target indicia.

7. Means as claimed in claim 1 wherein the forward surface of said missile has a forwardly facing hook or loop material.

* * * * *